US008179330B2

(12) United States Patent
Waltho

(10) Patent No.: US 8,179,330 B2
(45) Date of Patent: May 15, 2012

(54) OMNIDIRECTIONAL WIDEBAND ANTENNA

(75) Inventor: Alan E. Waltho, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 457 days.

(21) Appl. No.: 12/437,490

(22) Filed: May 7, 2009

(65) Prior Publication Data

US 2010/0283689 A1 Nov. 11, 2010

(51) Int. Cl.
*H01Q 11/12* (2006.01)

(52) U.S. Cl. ..... 343/742; 343/702; 343/867

(58) Field of Classification Search ..... 343/741, 343/742, 866, 867, 702
See application file for complete search history.

(56) References Cited

U.S. PATENT DOCUMENTS

| | | | | |
|---|---|---|---|---|
| 1,679,240 | A * | 7/1928 | Csanyi | 343/867 |
| 1,997,111 | A * | 4/1935 | Hardy | 342/428 |
| 2,280,562 | A * | 4/1942 | Weagant | 455/193.2 |
| 2,732,551 | A * | 1/1956 | Krauss | 343/843 |
| 7,009,399 | B2 * | 3/2006 | Olsson et al. | 324/326 |
| 7,215,292 | B2 * | 5/2007 | McLean | 343/725 |
| 2006/0164307 | A1 | 7/2006 | Smith et al. | |

FOREIGN PATENT DOCUMENTS

| | | |
|---|---|---|
| EP | 1 443 593 | 8/2004 |
| JP | 9223921 | 8/1997 |
| JP | 2002151948 | 5/2002 |
| KR | 20040096303 | 11/2004 |
| WO | WO-2010/129139 | 11/2010 |

OTHER PUBLICATIONS

International Search Report and Written Opinion for International Patent Application No. PCT/US2010/060675, Mailed Nov. 26, 2010, 9 pages.

* cited by examiner

*Primary Examiner* — Tho G Phan
(74) *Attorney, Agent, or Firm* — Kacvinsky Daisak, PLLC

(57) ABSTRACT

An antenna may comprise a first loop, a second loop, and a third loop, which are arranged to have a common intersection point on an axis that is common to the first, second, and the third loop. The first, second, and the third loop are mutually separated by an angle of separation to form a triple crossed loop antenna. The triple crossed loop antenna may provide omni-directional radiation pattern over wide band of frequency.

25 Claims, 4 Drawing Sheets

OMNIDIRECTIONAL WIDEBAND ANTENNA

BACKGROUND

Electronic devices are enabled to communicate with other electronic devices using wired and wireless (or radio) communication techniques. The electronic devices may transmit and receive radio signals using an antenna. The antenna may be designed to transmit and receive electromagnetic signals. The antenna may comprise physical elements such as conductors of various shapes and sizes. While transmitting, the antenna may generate a radiating electromagnetic field in response to an applied alternating voltage or current. The radiating electromagnetic field may form patterns (radiating patterns), which provide an insight into the strength of the radiating electromagnetic field in a specific direction. While receiving, the antenna placed in an electromagnetic field may allow the electromagnetic field to induce an alternating current in the antenna and a voltage between the terminals of the antenna.

Antennas may be classified in numerous ways. Based on the radiation pattern generated by the antennas, the antennas may be classified, for example, as omni-directional antennas and directional antennas. Based on the bandwidth in which the antennas may operate, the antennas may be classified as narrow-band, multi-band, and broadband antenna. Omni-directional antennas may be well suited for portable devices such as laptops, mobile internet devices, and cellular devices. Broadband antennas may be suited for applications such as ultra wide-band (UWB) or multiple radios using a single antenna. Omni-directional broadband antennas are essential, for example, in cognitive radio systems. The existing omni-directional antennas operate over small bandwidths, typically, 10% of the lowest operating frequency and these antennas operate at about 50% efficiency.

BRIEF DESCRIPTION OF THE DRAWINGS

The invention described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

The following description describes embodiments of an omni-directional wideband antenna. In the following description, numerous specific details such as transceiver implementations, resource partitioning, or sharing, or duplication implementations, types and interrelationships of system components are set forth in order to provide a more thorough understanding of the present invention. It will be appreciated, however, by one skilled in the art that the invention may be practiced without such specific details. In other instances, control structures, gate level circuits, and full software instruction sequences have not been shown in detail in order not to obscure the invention. Those of ordinary skill in the art, with the included descriptions, will be able to implement appropriate functionality without undue experimentation.

References in the specification to "one embodiment", "an embodiment", "an example embodiment", indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Figure 1:
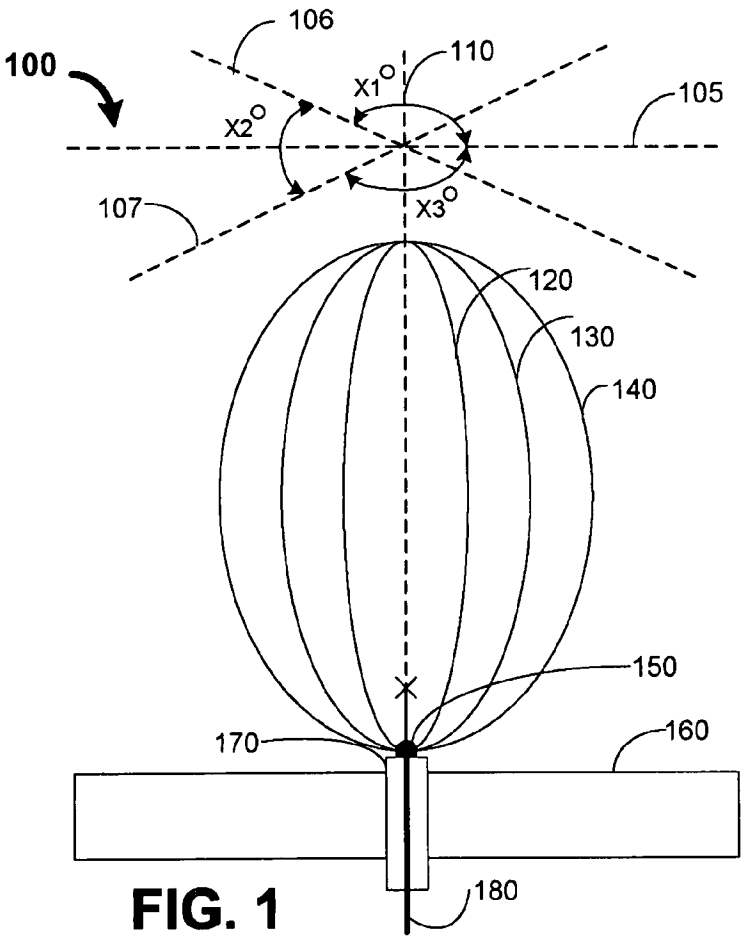
FIG. 1 illustrates a triple crossed loop elliptical antenna 100, which provides omni-directional radiating pattern over wideband in accordance with one embodiment.

An embodiment of an omni-directional wideband antenna 100 is illustrated in FIG. 1. In one embodiment, the omni-directional wideband antenna 100 may comprise a plurality of loops separated by an angle to provide omni-directional radiation pattern over a wideband of frequency. In one embodiment, the antenna 100 may comprise three elliptical loops, which may be mutually crossed at an angle of separation and such an antenna may be referred to as 'triple crossed loop elliptical antenna'.

In one embodiment, the triple crossed loop elliptical antenna 100 may comprise a first loop 120, a second loop 130, and a third loop 140, a ground plane 160, a support platform 170, and a coupler 180. In one embodiment, the first loop 120, a second loop 130, and a third loop 130 may be made of conducting material such as copper and aluminum.

In one embodiment, the shape and size of the first loop 120, the second loop 130, and the third loop 140 may be selected to increase the bandwidth over which the antenna 100 operates efficiently. In one embodiment, the loops 120, 130, and 140 separated by a common angle may provide an optimal omni-directional radiation pattern. In one embodiment, the thickness of the elements forming the loops 120, 130, and 140 may also be maintained as thin as possible in accordance with a chosen manufacturing technique and structural integrity to provide optimal bandwidth. However, circular, or rectangular, or any other such similar shaped loops, which may be separated by a common angle of separation of 120 degrees about a common axis, may provide an optimal omni-directional radiation pattern as well.

In one embodiment, the loops 120, 130, and 140 may be arranged along a common vertical axis 110 as shown in FIG. 1. In one embodiment, the loops 120, 130, and 140 may be separated by an angle of separation to provide omni-directional radiation pattern over a wideband. In one embodiment, the loops 120 and 130 may be separated by an angle of X1 degrees (i.e., angle between horizontal axis 105 and 106), the loops 130 and 140 may be separated by an angle of X2 degrees (i.e., angle between horizontal axis 106 and 107), and the loops 120 and 140 may be separated by an angle of X3 degrees (i.e., angle between horizontal axis 105 and 107).

In one embodiment, the angles X1, X2, and X3 may equal X. In one embodiment, the first loop 120, the second loop 130, and the third loop 140 may be mutually separated by a common angle of separation of 120 degrees. In one embodiment, the first loop 120 may be aligned at zero (0) degrees to the horizontal axis 105, the second loop 130 may be aligned at 120 degrees to the horizontal axis 105, and the third loop 140 may be aligned at 240 degrees to the horizontal axis 105. However, other alignments such as (30, 150, 270), (60, 180, 300), and other such combination may also provide an optimal omni-directional radiation pattern.

In one embodiment, the size of the loops 120, 130, and 140 may be selected to obtain a low return loss over a specific frequency range. In one embodiment, the height of the loops 120, 130, and 140 may be selected to be less than the quarter of the wavelength (Lamda) determined at the lowest operating frequency. In one embodiment, the maximum height of the loops 120, 130, and 140 may be selected as 2 centimeters, which may be about 0.2 Lamda of the lowest operating frequency of 2.1 gigahertz (GHz). In one embodiment, the major axis and minor axis of the loops 120, 130, and 140, while the shape is elliptical, may be selected in the ratio of 1.25:1, for example. In one embodiment, the thickness of the loops 120, 130, and 140 may be selected to obtain a return loss within a specific decibel value.

In one embodiment, the loops 120, 130, and 140 may be arranged such that the lowest points of each of the loops 120, 130, and 140 coincide at a common point on the vertical axis 110. In one embodiment, such a coinciding point of the loops 120, 130, and 140 on the common vertical axis 110 may be referred to as an 'intersection point 150'. In one embodiment, the intersection point 150 may be used as a feed-point to provide electric signals to the antenna 100. In other embodiment, the first loop 120, the second loop 130, and the third loop 140 may be are arranged to have a common intersection point at a diametrically opposite point to the intersection point 150 (i.e., the feed-point) on the axis 110. In one embodiment, the intersection point 150 of the loops 120, 130, and 140 may be supported by a dielectric 170. In one embodiment, the dielectric 170 may pass through the ground plane 160.

In one embodiment, the dielectric 170 with a high dielectric constant may be selected to decrease the overall size of the antenna 100. In one embodiment, the intersection point 150 may be coupled to a processing block through the coupling element 180. In one embodiment, the coupling element 180 may be inserted through a hole in the ground plane 160 to establish contact with the common intersection point 150. In one embodiment, the coupling element 180 may comprise a coaxial cable.

In one embodiment, the first loop 120 may be substantially bisected by the axis 110. In one embodiment, the second loop 130 may be substantially bisected by the axis 110 while touching the first loop 120 at the intersection point 150. In one embodiment, the third loop 140 may be substantially bisected by the axis 110 while touching the first loop 120 and the second loop 130 at the intersection point 150 along the axis 110. In one embodiment, the first loop 120, the second loop 130, and the third loop 140 may be substantially equally spaced apart around the axis 110.

In other embodiment, the loops 120, 130, and 140 may be elliptical in shape and the shape of the ellipse may be determined by a major and minor elliptical axes. In one embodiment, the loops 120, 130, and 140 may be arranged such that the major elliptical axes of the loops 120, 130, and 140 may lie along the axis 110. Also, the loops 120, 130, and 140 may be crossed at the intersection point 150, which may be used to feed the antenna 100 at a single end. In one embodiment, such an arrangement may cause the antenna 100 to generate a substantially omni-directional radiation pattern.

Figure 2:
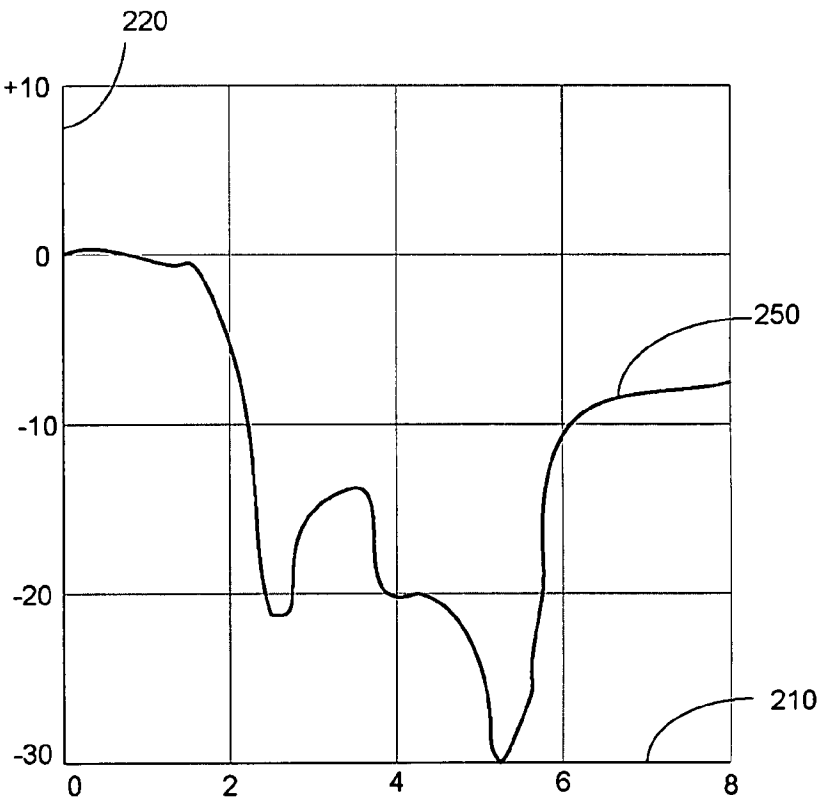
FIG. 2 is a graph 200, which depicts the return path loss for the antenna 100 of FIG. 1 in accordance with one embodiment.

A graph 200 depicting the return loss for the antenna 100 is illustrated in FIG. 2. In one embodiment, the frequency (f) in gigahertz (GHz) may be plotted along the x-axis 210, and the return loss (as S-parameter amplitude in decibels) may be plotted along the Y-axis 220. In one embodiment, the frequency range over which the graph is plotted is assumed to be between 2.1 GHz (lowest frequency) and 6.2 GHz (highest frequency point). In one embodiment, the plot 250 depicts that the return loss (the ratio of the power reflected back from the antenna 100 to the forward power toward the antenna 100) is less than −10 decibels over the frequency range of 2.1 GHz to 6.2 GHz.

Figure 3:
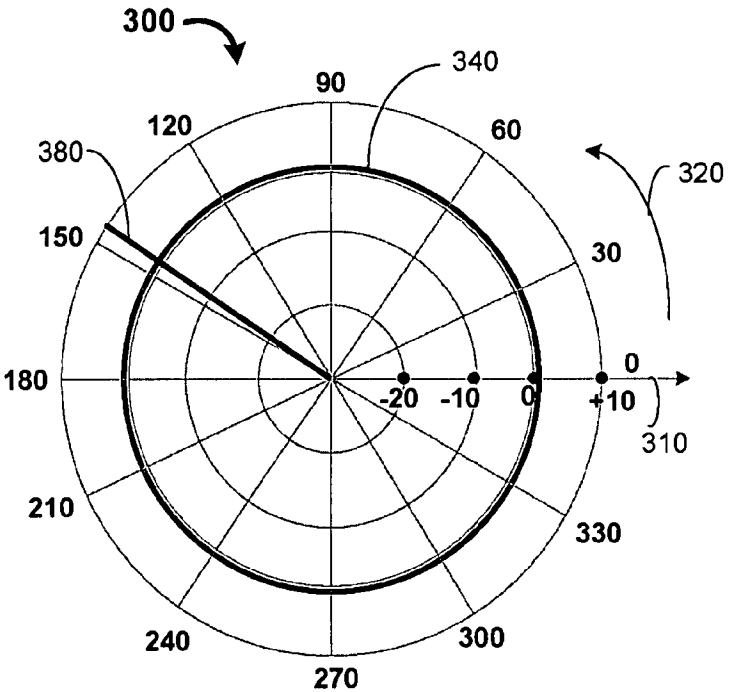
FIG. 3 illustrates an azimuth plane gain versus direction plot 300 of the antenna 100 operating at a first frequency in accordance with one embodiment.

A plot 300 of azimuth plane gain versus direction for the antenna 100 handling signals at a frequency of 5.4 GHz is illustrated in FIG. 3. In one embodiment, the gain and the direction measurements may be made using 3-dimensional (3D) electromagnetic field simulation tools or may be measured directly in an environment such as anechoic chamber. In one embodiment, the measurements may be made in far-field.

In one embodiment, the plot 300 depicts a gain axis 310 marked in decibels (db) and an azimuth angle axis 320 marked in degrees. In one embodiment, the gain axis 310 is marked with −20 db, −10 db, 0 db, and +10 db and the azimuth angle axis 320 is marked with 0, 30, 60, 90, 120, 150, 180, 210, 240, 270, 300, and 330 degrees. In one embodiment, the gain measurements are made for a frequency value of 5.4 GHz. In one embodiment, the plot 300 depicts an omni-directional main lobe 340, which has a gain value of 0.2 decibels and the direction of the main lobe 340 is indicated at 145 degrees measured from the gain axis 310.

Figure 4:
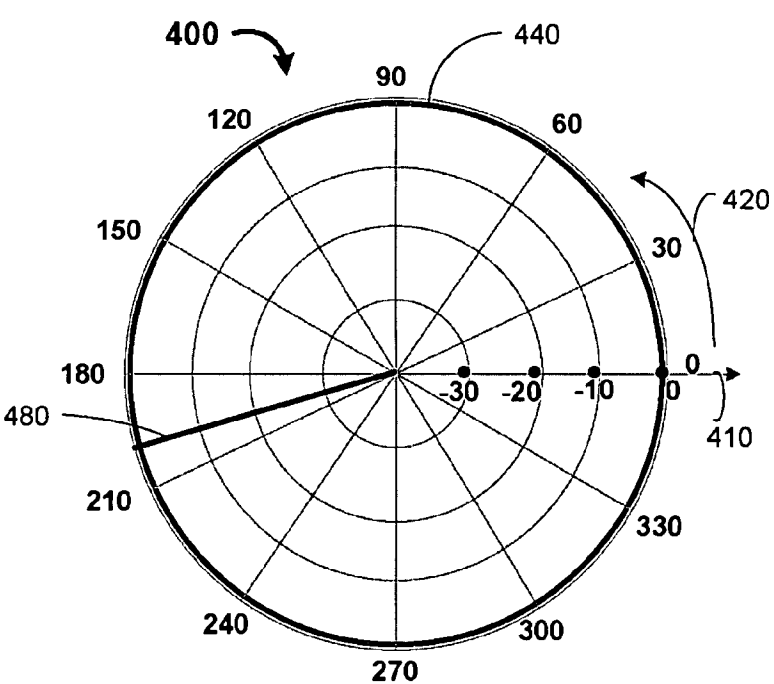
FIG. 4 illustrates an azimuth plane gain versus direction plot 400 of the antenna 100 operating at a second frequency in accordance with one embodiment.

A plot 400 of an azimuth plane gain versus direction for the antenna 100 handling signals at a frequency of 2.2 GHz is illustrated in FIG. 4. In one embodiment, the plot 400 is similar to the plot 300 except that the frequency of the signals handled by the antenna 180 is decreased to 2.2 GHz.

In one embodiment, the plot 400 depicts a gain axis 410 marked in decibels (db) and an azimuth angle axis 420 marked in degrees. In one embodiment, the gain axis 310 is marked with −30 db, −20 db, −10 db, and 0 db and the azimuth angle axis 420 is marked with 0, 30, 60, 90, 120, 150, 180, 210, 240, 270, 300, and 330 degrees. In one embodiment, the gain and the azimuth angle measurements are made for a frequency value of 2.2 GHz.

In one embodiment, the plot 400 depicts an omni-directional main lobe 440, which has a gain value of −0.8 decibels and the direction of the main lobe 440 is indicated at 200 degrees measured from the gain axis 410. In one embodiment, difference in the angle may be attributed to change in the frequency of the signal provided to the antenna 100. In one embodiment, the change in the frequency may cause a change in the phase separation between the first loop 120, the second loop 130, and the third loop 140.

As indicated in the plots 300 and 400, the antenna 100 may be used to provide an omni-directional radiation pattern (i.e., the main lobe 340 and 440) over a wideband. In one embodiment, the change in gain over a wide frequency band of BW1 (=3.2 GHz=5.4−2.2) is minimal i.e., one decibel (0.2−(−0.8)= 1 db). Thus, the antenna 100 may provide an omni-directional radiation pattern within 1 db over a bandwidth of 3.2 GHz, which is about 200% of the lowest frequency of 2.1 GHz as compared to a narrow band operation within 10% of the lowest frequency. In one embodiment, the antenna 100 may provide an omni-directional radiation pattern within a small gain band that may be about 300% of the lowest frequency value. Also, the antenna 100 may provide a radiation efficiency of at least 90 percent while many of the other small antennas may provide radiation efficiencies of less than 50 percent.

Figure 5:
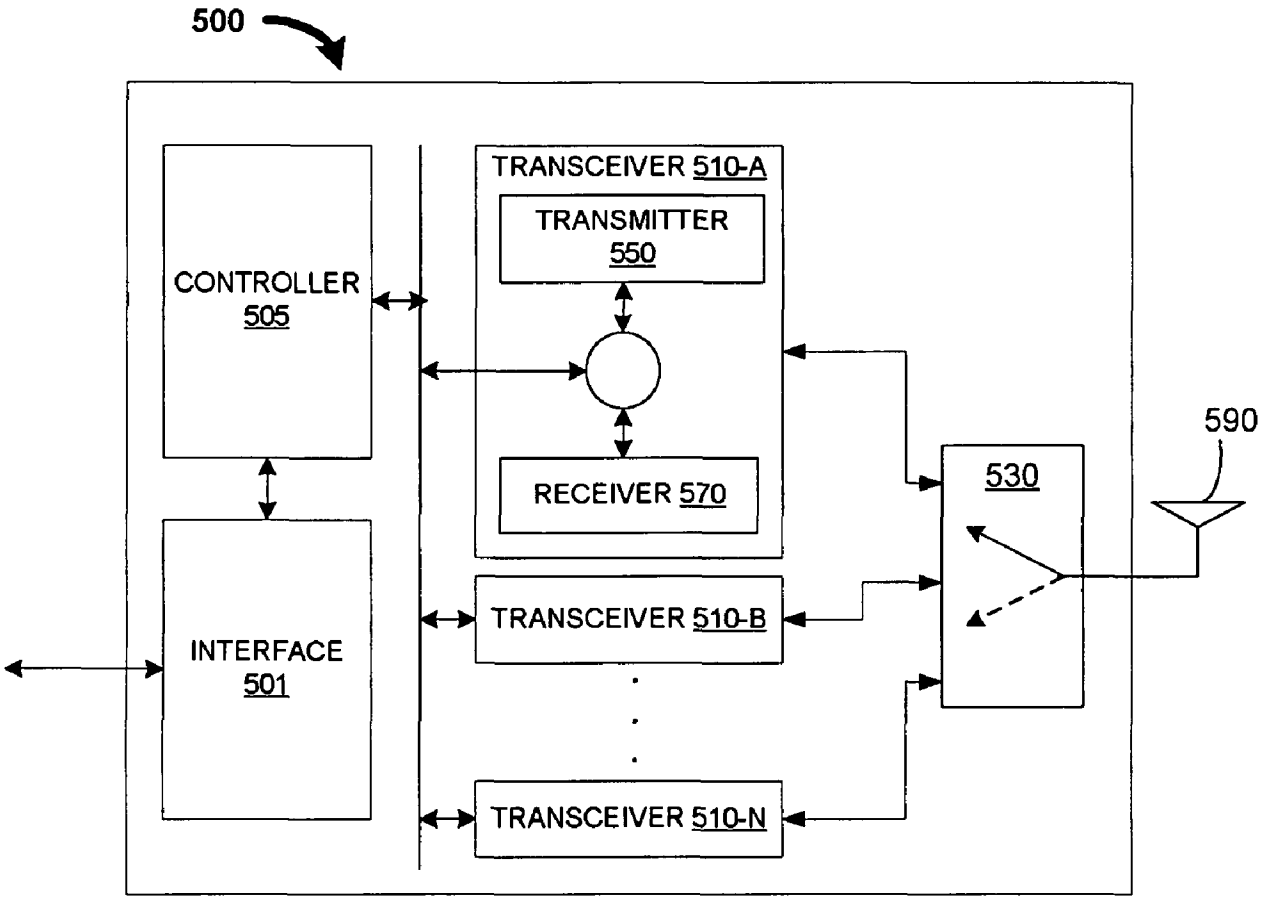
FIG. 5 illustrates multiple transceivers 500, which may use the antenna 100 in accordance with one embodiment.

An embodiment of a network interface card NIC 500, which supports an antenna 590 is illustrated in FIG. 5. In one embodiment, the NIC 500 may comprise an interface 501, a controller 505, transceivers 510-A to 510-N, a switch 530, and an omni-directional wideband antenna 590. In one embodiment, the antenna 590 may comprise a triple crossed loop elliptical antenna 100 described above.

In one embodiment, the interface 501 may couple the NIC 500 to the other blocks such as a platform block of a laptop computer, mobile internet device, handhelds, cell phones, televisions and such other systems. In one embodiment, the interface 501 may provide physical, electrical, and protocol interface between the NIC 500 and the other blocks.

In one embodiment, the controller 505 may maintain a track of the transmitter 510 that may be operational. In one embodiment, the controller 505 may control the modulation and demodulation techniques selected by the transceivers 510. In one embodiment, the controller 505 may control communication parameters such as the transmission rate and other parameters such as power consumption.

In one embodiment, the transceiver 510-A may comprise a transmitter 550 and a receiver 570. In one embodiment, each of the transceiver 510-B to 50-N may comprise a transmitter and receiver similar to the transmitter 550 and the receiver 570 of the transmitter 510-N. In one embodiment, while receiving the signals from the antenna 590, the receivers such as the receiver 570 of the transceivers 510-A to 510-N, may receive the signal from the antenna 590 through a switch 530. In one embodiment, while transmitting the signals, the transmitters such as the transmitter 550 of the transceivers 510 may provide the radio signal to the antenna 590 through the switch 530.

In one embodiment, the transmitter 550 may receive signals to be transmitted from the controller 505 or directly form the interface 501 under the control of the controller 505. In one embodiment, the transmitter 550 may modulate the signals using techniques such as phase, or amplitude, or frequency modulation techniques. In one embodiment, the transmitter 550 may then transmit the signals to the antenna 590 through the switch 530. In one embodiment, the receiver 570 may receive electrical signals from the antenna 590 and demodulate the signals before providing the demodulated signals to the controller 505 or directly to the interface 501.

In one embodiment, the switch 530 may couple a transmitter of the transmitters 510 to the antenna 590 on time sharing basis, for example. In one embodiment, the switch 530 may couple a specific transceiver 510 to the antenna 590 in response to an event such as a selection control signal of the controller 505. In other embodiment, the switch 530 may be provided with intelligence to couple an appropriate transmitter 510 to the antenna 590. In one embodiment, the switch 530 may couple the antenna 590 to the transmitter 550 while the transmitter 550 may be ready to transmit signals out to a receiver in other system. In one embodiment, the switch 530 may couple the antenna 590 to the receiver 570, while the antenna 590 has generated signals to be provided to the receiver 570.

In one embodiment, while transmitting the 590 may receive alternating voltage/current signals from the transceiver 510, which may be ready for transmitting signals and may generate an electromagnetic field. In one embodiment, the antenna 590 may generate an omni-directional radiation pattern over a wide frequency band. In one embodiment, the antenna 590 may generate an omni-directional radiation pattern for a change in frequency between 2.1 GHz and 6.2 GHz. In one embodiment, while receiving, the antenna 590 may generate electric signals in response to being exposed to an electromagnetic field. In one embodiment, the antenna 590 may be coupled to a switch 530.

Figure 6:
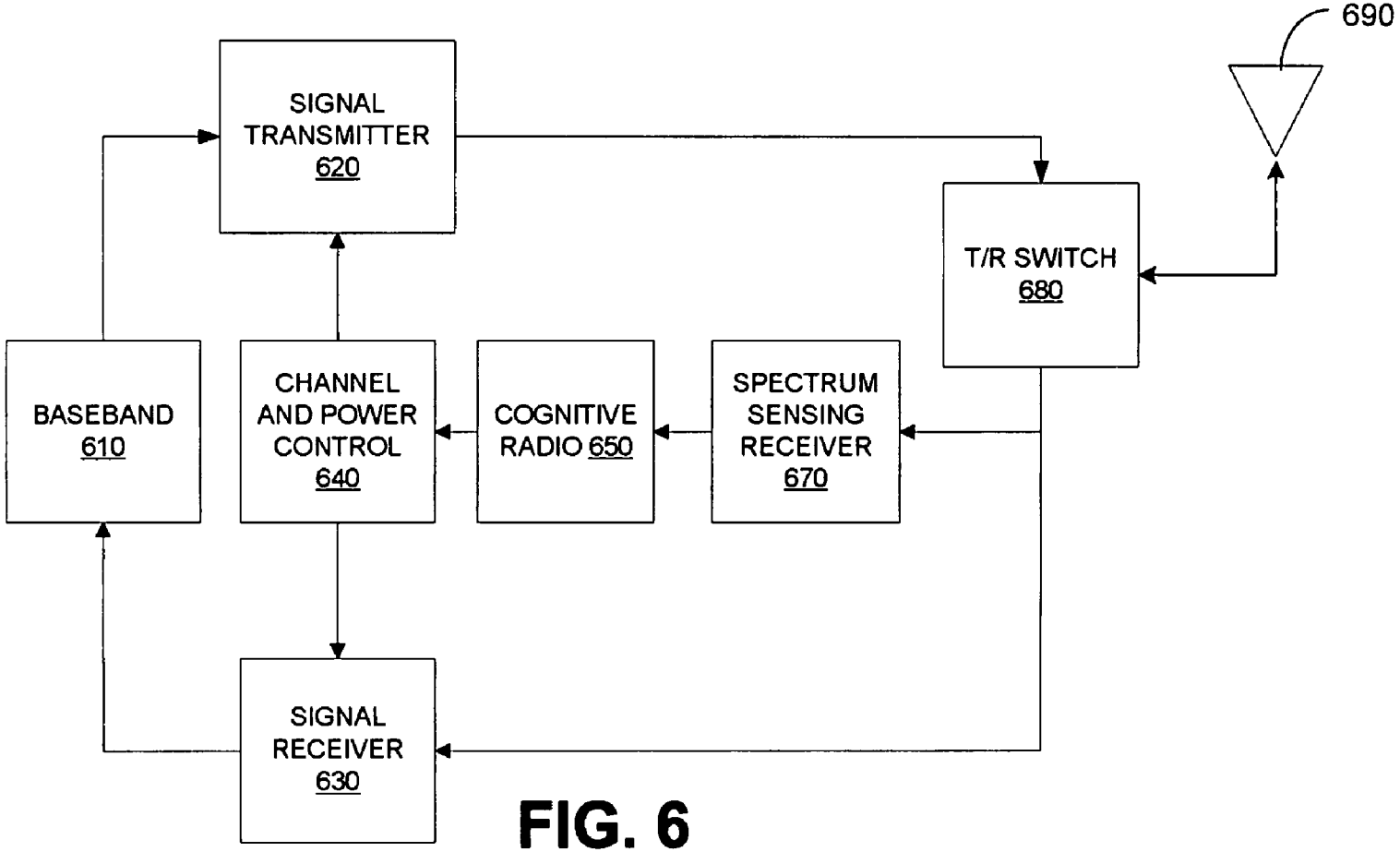
FIG. 6 illustrates a cognitive radio system 600 in accordance with one embodiment.

An embodiment of a cognitive radio system 600, which may use an omni-directional wideband antenna such as the triple crossed loop elliptical antenna 100 is illustrated in FIG. 6. In one embodiment, the cognitive radio system 600 may comprise a baseband 610, a signal transmitter 620, a signal receiver 630, a channel and power control block 640, a cognitive radio 650, a spectrum sensing receiver 670, a T/R switch 680, and an omni-directional wideband antenna 690.

In one embodiment, the antenna 690 may provide an omni-directional radiation pattern over a wide frequency band as described above. Such an approach may enable a single antenna 690 to be used for transmitting and receiving signals processed using technologies such as Wi-Fi, WI-MAX, UMG, UWB, television signals, and such other similar signals. Such an approach may avoid use of multiple antennas, which may reduce cost and conserve space within the system such as the system 600.

In one embodiment, while receiving signals, the omni-directional wideband antenna 690 may be provided the signals to the T/R switch 680. In one embodiment, while transmitting signals, the omni-directional wideband antenna 690 may transmit the signals received from the signal transmitter 620. In one embodiment, the T/R switch 680 may comprise intelligence to switch between the signal transmitter 620 and the signal receiver 630.

In one embodiment, the spectrum sensing receiver 670 may detect unutilized portions (holes) of the spectrum and use the holes to meet the demand of the spectrum. In one embodiment, the cognitive radio 650 may receive sensing signals from the spectrum sensing receiver 670 and may generate information on the channels that may be used. In one embodiment, the cognitive radio 650 may provide such information to the channel and power control 640. In one embodiment, the channel and power control 640 may control the channels and the power consumed by the channels by controlling the signal transmitter 620 and the signal receiver 630.

In one embodiment, the signal transmitter 620 may receive signals from the baseband 610 and may modulate the signals using techniques such as phase, amplitude, and frequency modulation. In one embodiment, the signal receiver 630 may receive signals from the antenna 690 and may demodulate the signals before providing the demodulated signals to the baseband 610. In one embodiment, the baseband 610 may receive signals from the processing blocks of the system and may perform baseband processing before sending the signals to the signal transmitter 620. In one embodiment, the baseband 610 may receive demodulated signals from the signal receiver 630 and may perform baseband processing before providing the signals to the processing blocks of the system 600.

Certain features of the invention have been described with reference to example embodiments. However, the description is not intended to be construed in a limiting sense. Various modifications of the example embodiments, as well as other embodiments of the invention, which are apparent to persons skilled in the art to which the invention pertains are deemed to lie within the spirit and scope of the invention.

What is claimed is:

1. An antenna comprising:

a plurality of loops comprising a first loop, a second loop, and a third loop, wherein the first loop is substantially bisected by a common axis, the second loop is substantially bisected by the common axis and touches the first loop at an intersection point along the common axis, and the third loop is substantially bisected by the common axis and touches the first loop and the second loop at the intersection point along the common axis, wherein the first loop, the second loop, and the third loop are substantially equally spaced apart around the common axis, wherein the first loop, the second loop, and the third loop cross each other at a common feed point with longer axes of the first loop, the second loop, and the third loop arranged along a common central axis passing through the common feed point, wherein the second loop is positioned at a first angle to the first loop, the third loop is positioned at a second angle to the second loop, and the first loop is positioned at a third angle to the third loop, and wherein the crossed loop antenna containing the first loop, the second loop, and the third loop is to generate an omni-directional over a wideband of frequency.

2. The antenna of claim 1, wherein the first loop, the second loop, and the third loop are made of conducting material.

3. The antenna of claim 2, wherein the thickness of the conducting material forming the first loop, the second loop, and the third loop is substantially thin compared to the length of a longer axis of the first loop, the second loop, and the third loop.

4. The antenna of claim 1, wherein intersection point on the common axis is a point proximate to a ground plane on which the first loop, the second loop, and the third loop are provisioned.

5. The antenna of claim 1, wherein intersection point on the common axis is a point distant to a ground plane on which the first loop, the second loop, and the third loop are provisioned.

6. The antenna of claim 1, wherein the dimension of the first loop, the second loop, and the third loop are selected based on a lowest desired operating frequency.

7. The antenna of claim 1, wherein the antenna is to provide an omni-directional radiation pattern within a frequency band limited by the lowest operating frequency and the highest operating frequency, wherein the lowest desired operating frequency is substantially less than a highest operating frequency.

8. The antenna of claim 7, wherein the shape of a first omni-directional pattern provided by the antenna at the lowest operating frequency is substantially same as the shape of a second omni-directional provided by the antenna at the highest operating frequency.

9. An apparatus comprising:

a first elliptical loop, a second elliptical loop, and a third elliptical loop, wherein major axes of the first elliptical loop, the second elliptical loop, and the third elliptical loop lie along a common axis and the first elliptical loop, the second elliptical loop, and the third elliptical loop crossed at a common point located on the common axis, and wherein the first elliptical loop, the second elliptical loop, and the third elliptical loop are arranged to be apart from each other by a common angle to generate a substantially omni-directional radiation pattern, wherein the first elliptical loop, the second elliptical loop, and the third elliptical loop cross each other at a common feed point with longer axes of the first elliptical loop, the second elliptical loop, and the third elliptical loop arranged along a common central axis passing through the common feed point, wherein the second elliptical loop is positioned at a first angle to the first elliptical loop, the third elliptical loop is positioned at a second angle to the second elliptical loop, and the first elliptical loop is positioned at a third angle to the third elliptical loop, and wherein the apparatus is to generate an omni-directional over a wideband of frequency.

10. The apparatus of claim 9, wherein the first elliptical loop, the second elliptical loop, and the third elliptical loop are made of a conducting material.

11. The apparatus of claim 10, wherein the major axis and minor axis of the first elliptical loop, the second elliptical loop, and the third elliptical loop is selected based on a lowest desired operating frequency.

12. The apparatus of claim 11, wherein the lowest operating frequency is 2.1 gigahertz.

13. The apparatus of claim 9, wherein the major axes of the first elliptical loop, the second elliptical loop, and the third elliptical loop is at least 1.25 times longer than minor axes of the first elliptical loop, the second elliptical loop, and the third elliptical loop.

14. The apparatus of claim 13, wherein highest desired operating frequency is at least twice the lowest desired operating frequency.

15. The apparatus of claim 9, wherein the common angle that separates the first elliptical loop, the second elliptical loop, and the third elliptical loop is 120 degrees.

16. The apparatus of claim 15, wherein the gain in decibels of the omni-directional radiation pattern is 0.2 decibels at an operating frequency of 5.4 gigahertz.

17. The apparatus of claim 15, wherein the gain in decibels of the omni-directional radiation pattern is −0.8 decibels at an operating frequency of 2.1 gigahertz.

18. A radio system comprising:

a plurality of transmitters, a plurality of receivers, and a crossed loop antenna containing three elliptical loops coupled to the plurality of transmitters and the plurality of receivers, wherein the three elliptical loops cross each other at a common feed point with longer axes of the three elliptical loops arranged along a common central axis passing through the common feed point, wherein a second loop of the three elliptical loops is positioned at a first angle to the first loop, a third loop of the three elliptical loops is positioned at a second angle to the second loop, and a first loop of the three elliptical loops is positioned at a third angle to the third loop, wherein the crossed loop antenna containing three elliptical loops is to generate an omni-directional over a wideband of frequency.

19. The system of claim 18, wherein the wideband of frequency is bound by a higher frequency value and a lower frequency value, wherein the higher frequency value is at least 20 percent higher than the lower frequency value.

20. The system of claim 19, wherein the longer axes of the three elliptical loops is less than 2 centimeters.

21. The system of claim 19, wherein the longer axes of the three elliptical loops is 0.2 Lamda, the wavelength measured at the lower frequency value.

22. The system of claim 19, wherein the higher frequency value is 6.2 gigahertz and the lower frequency value is 2.1 gigahertz.

23. The system of claim 18, wherein the higher frequency value is at least 200 percent higher than the lower frequency value.

24. The system of claim 18, wherein the higher frequency value is 300 percent higher than the lower frequency value.

25. The system of claim 18, wherein the crossed loop antenna containing three elliptical loops provides a radiation efficiency of at least 90 percent.

* * * * *